United States Patent [19]

Bauer

[11] 4,165,189

[45] Aug. 21, 1979

[54] CHARACTERS CARRYING DISC FOR A PRINTING MACHINE

[75] Inventor: Alfred Bauer, Neuchâtel, Switzerland

[73] Assignee: Caracteres S.A., Neuchâtel, Switzerland

[21] Appl. No.: 823,946

[22] Filed: Aug. 12, 1977

[30] Foreign Application Priority Data

Jun. 8, 1977 [CH] Switzerland ..... 7087/77

[51] Int. Cl.[2] ..... B41J 1/30

[52] U.S. Cl. ..... 400/144.2; 101/93.19

[58] Field of Search ..... 197/6.7, 53, 54; 400/144.2, 144.3, 144.4

[56] References Cited

U.S. PATENT DOCUMENTS

| | | | |
|---|---|---|---|
| 3,366,212 | 1/1968 | McInnis | 197/6.7 |
| 3,677,386 | 7/1972 | Herterich et al. | 197/53 |
| 3,921,277 | 11/1975 | Tramposch | 197/53 X |
| 3,921,784 | 11/1975 | Orlens | 197/54 |

*Primary Examiner*—Paul T. Sewell

*Attorney, Agent, or Firm*—Silverman, Cass & Singer, Ltd.

[57] ABSTRACT

A character-bearing disc operable with a printing machine having a central hub with radially extending flexible arm members, each arm member having a character disposed on an outer portion thereof. The arm members are reinforced at the inner ends thereof by means of longitudinally extending reinforcing ribs, the arm members thus having increased strength at their inner ends without sacrifice of the flexibility necessary to proper function of the disc.

11 Claims, 3 Drawing Figures

CHARACTERS CARRYING DISC FOR A PRINTING MACHINE

The present invention relates to a characters carrying disc for a printing machine comprising a central hub provided with resilient radial arms which are thinner than the said central hub, and which present, at their end, the characters.

Such discs, which are in most cases realized in plastic material, are known per se.

Due to the very high speed of rotation to which these discs are submitted as well as the speed and the printing force of the hammer which cooperates with the end of their resilient arms, these arms are submitted to very high sollicitations, so that they become frequently broken.

It is not easy to reinforce these arms without jeopardizing their elasticity, which is absolutely necessary for permitting that, after each printing, the deformed arm resumes instantaneously its rest position.

The purpose of the present invention is to furnish a solution to this problem.

To this effect, the characters carrying disc according to the invention is characterized by the fact that its elastic arms are each provided, at their root, with a longitudinal reinforcing rib increasing their resistance regarding the deformations, in any direction, to which they are submitted.

The drawing shows, by way of example, one embodiment of the object of the invention.

Figure 1:
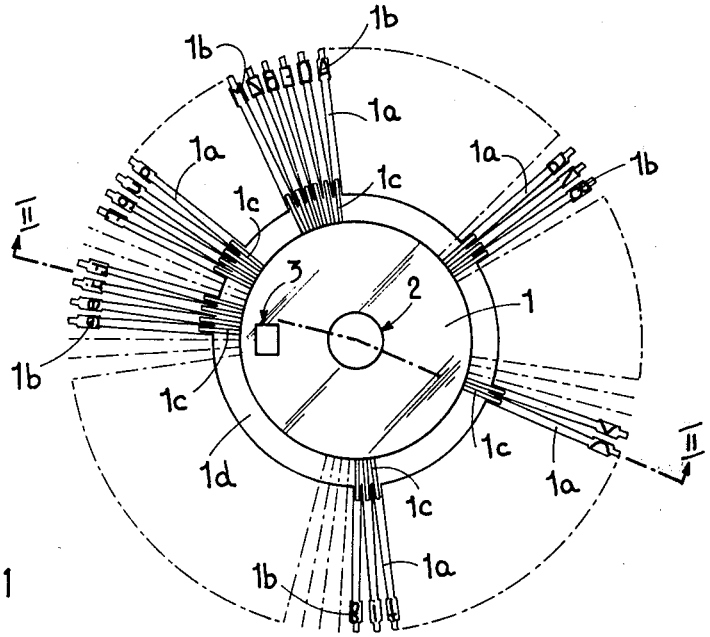
FIG. 1 is a plan view of a characters carrying disc.
Figure 2:
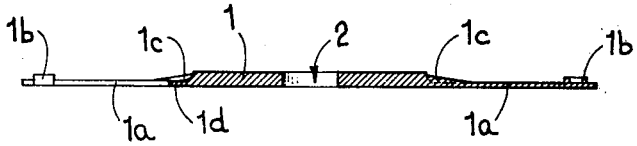
FIG. 2 is a sectional view along line II—II of FIG. 1.
Figure 3:
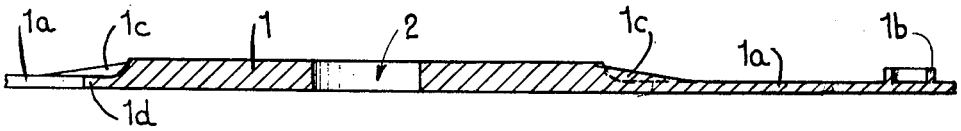
FIG. 3 is a partial enlarging of the sectional view of FIG. 2.

The characters carrying disc represented, made of plastic material, obtained for instance by moulding, comprises a hub 1 provided with a central hole 2, permitting its engagement on a shaft of the printing machine on which it is intended to be used, and with an aperture 3 which is engaged by a driving member for the disc, which is part of the said machine.

This disc comprises radial arms 1*a*, which are resiliently deformable, the height or thickness of which is lower than the thickness of the hub 1 and which are provided, at their end, with characters designated by 1*b*.

Each arm 1*a* is provided, at its root, with a longitudinal reinforcing rib 1*c* the height of which is diminishing from the hub 1 in the direction of the end of the arm. These ribs extend above the perimetric edge portion, which is thinner, designated by 1*d*, of the hub 1. The ribs 1*c* are relatively short, the portions thereof which extend onto the resilient arms being seven to nine times shorter than the resilient arms themselves. The ribs 1*c* are seen to join at inner ends to facing portions of the hub 1, the ribs further joining to the perimetric edge portion 1*d* and then to the arms 1*a* at the outer ends of said ribs. The portions of the ribs 1*c* which extend beyond the perimetric edge portion 1*d* are seen to be of lengths which are minor portions of the lengths of the arms 1*a*.

These ribs do not reduce the elasticity of the arms 1*a* but increase their resistance regarding the deformations, as well as axial as lateral, to which the arms are submitted during the printing, as well as during the rotation of the disc.

What I claim is:

1. A character-bearing disc for operation in a printing machine, comprising:

a hub having a central disc-like body portion and a perimetric edge portion formed about the periphery of the body portion, the perimetric edge portion being reduced in thickness relative to the central body portion of the hub;

resilient arm members formed integrally with the hub, the arm members extending radially from and connecting integrally to the perimetric edge portion of the hub;

means for reinforcing the portion of each arm member nearmost the hub, said means comprising at least one reinforcing rib disposed on an outward face of each arm member, the rib extending longitudinally of the arm member and being joined at an inner end to a facing portion of the central body portion adjacent the perimetric edge portion, the rib being joined along at least a portion of one edge thereof to a surface face of the perimetric edge portion, the rib extending radially of the perimetric edge portion beyond the periphery of said perimetric edge portion to contact and join to the arm member at a portion of said arm member adjacent the perimetric edge portion, the portion of the rib which extends beyond the outer periphery of the perimetric edge portion being of a radial length which is a minor portion of the radial length of the arm member; and, means disposed on outer portions of the arm members for producing a printing impression.

2. The disc of claim 1 wherein the height of the reinforcing ribs diminishes from the central body portion of the hub toward the arm members.

3. The disc of claim 1 wherein the hub, the arm members, and the reinforcing ribs are integral.

4. The disc of claim 1 wherein the thickness of the arm members is equal to the thickness of the perimetric edge portion.

5. The disc of claim 1 wherein the radial length of the reinforcing ribs is a minor portion of the radial length of the arm members.

6. The disc of claim 1 wherein the radial dimension of the perimetric edge portion is less than the radial dimension of the central body portion of the hub.

7. The disc of claim 1 wherein the radial dimension of the perimetric edge portion is a minor portion of the radial length of the arm members.

8. The disc of claim 1 wherein the portion of the reinforcing rib which extends beyond the outer periphery of the perimetric edge portion is a minor portion of the radial length of the rib.

9. The disc of claim 1 wherein the highest portion of each reinforcing rib does not extend above a planar surface face of the central body portion of the hub.

10. The disc of claim 1 wherein the transverse thickness of each reinforcing rib is less than the transverse thickness of each arm member.

11. The disc of claim 1 wherein the portions of the ribs which extend beyond the perimetric edge portion are of radial lengths which are 7 to 9 times shorter than the radial length of the arm members.

* * * * *